United States Patent [19]

DuPont, Jr.

[11] Patent Number: 4,858,282

[45] Date of Patent: Aug. 22, 1989

[54] BRAIDED METAL-PLASTIC SHOE LACE

[76] Inventor: Charles E. DuPont, Jr., 312 N. Sierra Ave., Solana Beach, Calif. 92075

[21] Appl. No.: 215,318

[22] Filed: Jul. 5, 1988

[51] Int. Cl.[4] ..... A43C 9/00

[52] U.S. Cl. ..... 24/143 R; 24/140

[58] Field of Search ..... 24/143 R, 143 A, 143 B, 24/140; 57/204, 210, 224, 232; 87/8, 1

[56] References Cited

U.S. PATENT DOCUMENTS

| | | | |
|---|---|---|---|
| 939,839 | 11/1909 | Hines | 24/143 R |
| 2,306,515 | 12/1942 | Wright | 24/143 R |
| 2,477,151 | 7/1942 | Stapleton | 24/143 R |
| 3,917,448 | 11/1975 | Wood | 8/125 |
| 4,384,548 | 5/1983 | Cohn | 119/109 |

FOREIGN PATENT DOCUMENTS

| | | | |
|---|---|---|---|
| 909448 | 5/1946 | France | 24/143 R |
| 182673 | 7/1922 | United Kingdom | 24/143 R |

*Primary Examiner*—Kenneth J. Dorner
*Assistant Examiner*—Laurie K. Cranmer

[57] ABSTRACT

A slip-resistant and durable shoe lace with improved gripping power is formed by braiding nylon with Lurex, a vacuum metalized and resin-coated polyester film.

8 Claims, 1 Drawing Sheet

BRAIDED METAL-PLASTIC SHOE LACE

FIELD OF THE INVENTION

This invention relates generally to shoe laces and particularly to slip-resistant, safe and durable shoe laces for use in such activities as jogging, running, skating, skiing and the like. More specifically, this invention is concerned with such shoe laces formed of braided metal and plastic and to a method of forming these braided shoe laces.

BACKGROUND OF THE INVENTION

It is a matter of common experience that shoe laces often come untied when a person is walking or conducting sport activities such as jogging, running, playing ball, skating or skiing. The tendency of a shoe lace to come untied can, of course, become dangerous because it can cause tripping or falling which may result in serious injury. As mentioned in U.S. Pat. No. 4,247,967, ordinary shoe laces loosen or come untied because they are usually formed of relatively smooth woven yarn material. The smooth surface of laces made of such yarns provide little gripping power at the points where the laces cross. Accordingly, said patent discloses a shoe lace made of a binding having "hook-type" (male) and "loop-type" (female) fastening material such as Velcro. The male and female Velcro fasteners are readily engaged by pressing the complementary fabric unit together and insures against loosening of the lace, or coming untied. In order to untie the shoe lace, the fastening means are disengaged by peeling the complementary portions apart from each other.

Others who have been concerned with the safety of joggers and runners who exercise at night, have suggested the use of shoe laces which have enhanced visibility. Thus, as disclosed in U.S. Pat. No. 4,651,447, shoe laces are provided which are formed of materials having at least one exposed retroreflective surface, and an adhesive surface.

Neither one of the aforementioned patents is concerned with braided shoe laces. However, U.S. Pat. No. 4,423,539 discusses several earlier patents relating to shoe laces including shoe laces made of woven or braided elastic strands. As further indicated in said patent, elastic laces have been commonly made in the past by braiding cotton or other textile yarn around an elastic rubber core. Even though such laces are elastic, "they are not at all durable or satisfactory for running shoes." In order to improve the durability and stretchability of the shoe laces, the aforementioned patent recommends employing a plurality of spacedly-arranged longitudinal elastic strands held together by cotton in a web configuration. So far as it is known, however, braided shoe laces of the type described or referred to in U.S. Pat. No. 4,423,539 are not entirely satisfactory because they lack one or more of the essential requirements which insures against the shoe lace coming untied, or they lack the requisite degree of durability.

It is therefore an object of the present invention to provide slip-resistant durable shoe laces which are particularly suitable for footwear used by joggers, runners and by persons participating in other sports activities.

It is another object of this invention to provide shoe laces which do not loosen or come untied during use.

It is also an object of this invention to provide shoe laces which, in addition to the foregoing characteristics, are safe and provide a retroreflective surface to enhance the visibility in the dark.

It is yet another object of this invention to provide shoe laces having the improved safe and attractive features heretofore described.

The foregoing and other advantages and features of this invention will be more readily comprehended from the ensuing detailed description and the accompanying drawings.

SUMMARY OF THE INVENTION

In accordance with the present inventions, nylon threads are braided with Lurex, a vacuum metalized polyester firm, by forming repeated, crisscross patterns of the nylon threads woven onto Lurex. In forming the braided shoe lace, the nylon threads are woven onto the Lurex film such that the nylon thread cross over and under the metal yarn repeatedly along the length of the shoe lace, with the nylon forming densely spaced twisted nylon threads woven onto the Lurex.

BRIEF DESCRIPTION OF THE DRAWINGS

In the drawings, wherein like reference numerals are employed to designate like parts.

DETAILED DESCRIPTION OF THE INVENTION

Figure 1:
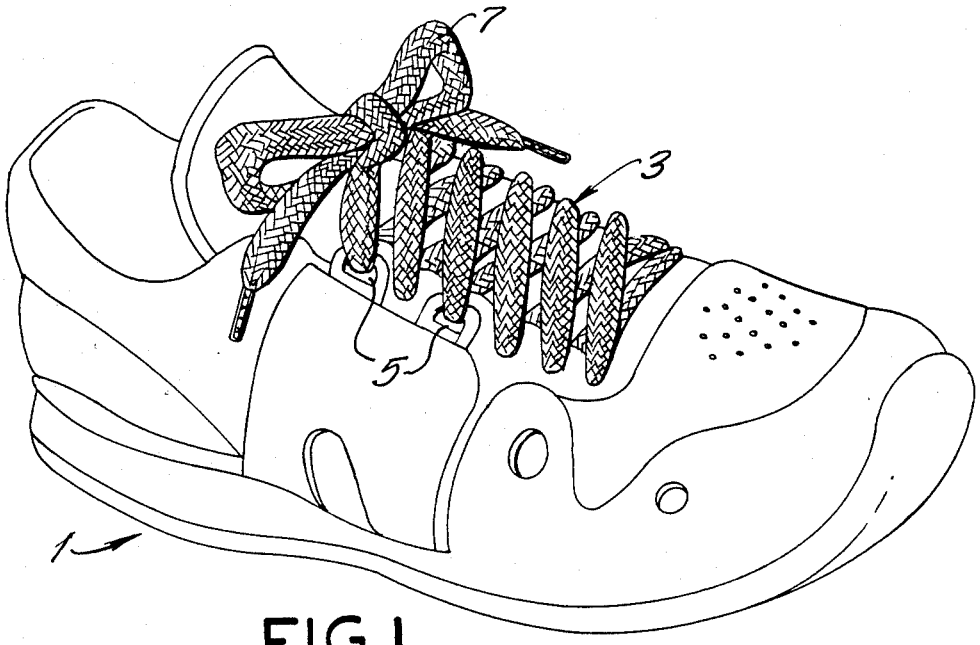
FIG. 1 is a perspective view of a footware, e.g., a jogging shoe, using the shoe lace of the present invention.

Referring now to the drawings, first to FIG. 1, there is shown a conventional jogging shoe 1, having a shoe lace 3, threaded through the shoe openings 5, in conventional manner, and tied into a bow as in 7.

Figure 2:
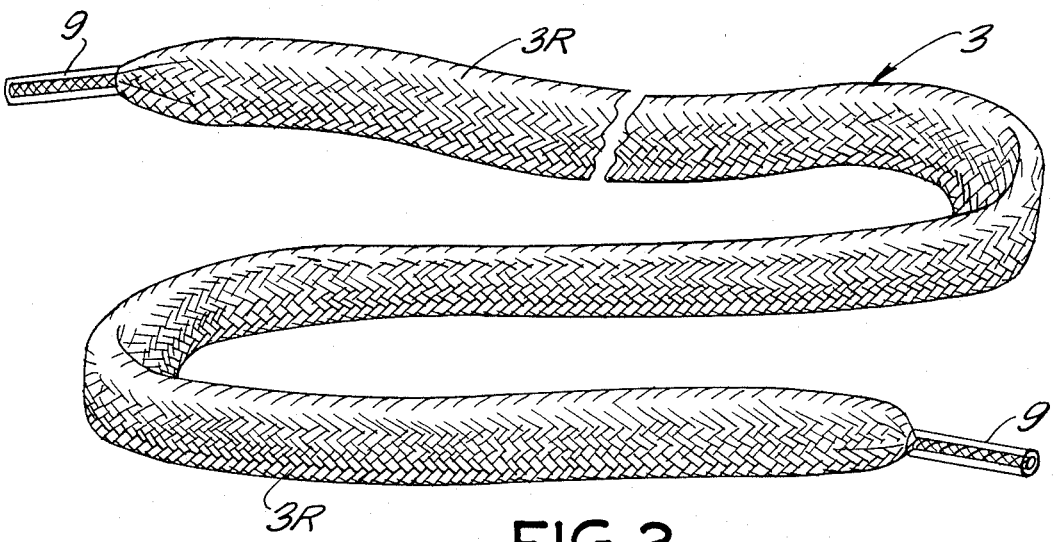
FIG. 2 is a perspective view of a shoe lace formed in accordance with the present invention from a combination of braided Lurex film and nylon threads.
Figure 3:
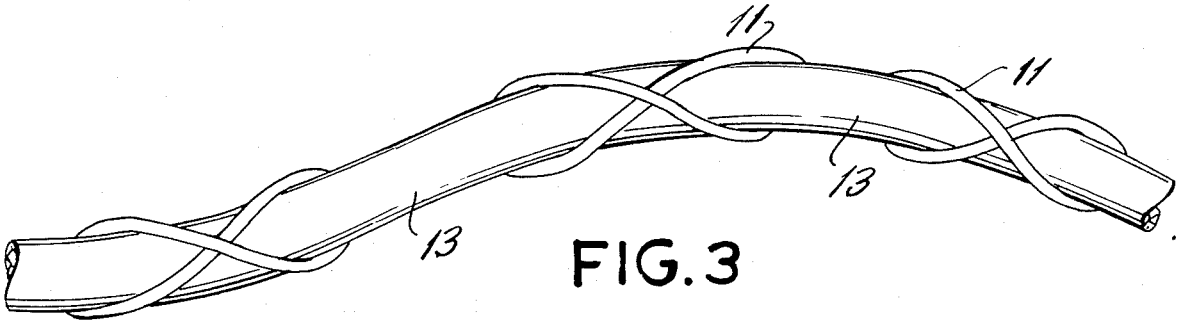
FIG. 3 is an enlarged, partly sectional view showing each nylon thread or filament braided with Lurex film, in exaggerated dimensions.

The shoe lace 3 is shown in perspective view in FIG. 2 and includes the tips 9,9 formed in conventional manner such as in U.S. Pat. Nos. 1,465,754 and 1,948,844 or by other known means. The shoe lace shown in FIG. 2 has a reflective surface 3R for safety and enhanced visibility. The shoe lace of the present invention is formed by braiding nylon filaments 11 with a Lurex film 13 as illustrated in FIG. 3, in exaggerated dimensions and relative spacings. So far as it is known, no shoe laces have heretofore been made by braiding nylon threads or filaments with Lurex.

Lurex is the registered trademark of the Metal Film Company, Inc., New York, N.Y., which is a subsidiary of Rockwood Industries, Inc. Lurex is a clear polyester film, approximately ½ mil. thick and 1/69 inches wide which is vacuum metalized and resin coated on one side. Thus, as a practical matter, Lurex is principally a polyester film which, because of its surface treatment with aluminum has a metallic luster and is therefore sometimes referred to in the trade as metallic film or metallic polyester film. Its resin-coated surface also imparts remarkable gripping power which, when braided with nylon threads, results in shoe laces of exceptional properties.

In order to achieve a combination of the desired features for the shoe lace of the present invention, a pair of nylon threads are woven in crisscrossing pattern over the Lurex film such that each nylon thread crosses once over and once under the Lurex film surface to thereby form a repeated, generally X-shaped patterns of nylon threads which are densely spaced and interwoven onto the Lurex film. For optimum properties, the nylon threads are woven by twisting them over and under the Lurex film as aforesaid so as to result in a shoe lace having about 5 to about 10 twists per inch length of the Lurex film. Also generally, the finished shoe laces will typically consist of about 50–55 wt. % of Lurex and about 45–50 wt. % of nylon threads.

Thus, when nylon threads are braided with Lurex as aforesaid, the resulting shoe laces exhibit several improved features compared to conventional shoe laces. Thus, because of the texture and weave of nylon and Lurex, the braided shoe lace does not become untied during use, a difficulty which is common in ordinary shoe laces. Moreover, the resulting nylon-Lurex braided shoe lace is stronger than ordinary shoe laces, including cotton shoe laces. Additionally, the shoe laces of the present invention may be made reflective for safety and are fashionable on the footwears because of their luster and aesthetic appearance. The improved features of the shoe laces of the present invention are due to the unique interengagement between nylon and Lurex, a combination not heretofore used in making shoe laces.

In forming the Lurex, the polyester film is first subjected to vacuum metalization using known processes and aluminum as the metal. After vacuum metalization, the resulting vacuum metalized polyester is coated on one side with a suitable resin. Obviously, the coating thickness of the metal and the resin can vary somewhat, however, they are usually extremely small, of the order of about a few mils. It suffices to say that the vacuum metalization and resin coating of the polyester film as aforesaid imparts to the resulting film, the Lurex, the qualities and properties which contribute to the unique feature of the shoe laces of the present invention.

I claim:

1. As a new article of manufacture, a shoe lace made of nylon threads braided with vacuum metalized and resin-coated polyester film, wherein said nylon threads are interwoven with said vacuum metalized and resin-coated polyester film so as to form a repeated crisscross generally x-shaped, twisted patterns along the length of said polyester film.

2. A shoe lace as in claim 1 wherein said nylon threads and said vacuum metalized and resin-coated polyester film constitute from about 45–50 wt. % and about 55–50 wt. % respectively within shoe lace.

3. A shoe lace as in claim 2 wherein said nylon threads are interwoven onto said polyester film at about 6 to about 10 twists per inch length of the polyester film.

4. A shoe lace as in claim 3 wherein said shoe lace has a retroreflective surface.

5. A shoe lace as in claim 2 wherein said shoe lace has a retroreflective surface.

6. A shoe lace as in claim 1 wherein said nylon threads are interwoven onto said polyester film in about 5 to about 10 twists per inch length of the polyester film.

7. A shoe lace as in claim 6 wherein said shoe lace has a retroreflective surface.

8. A show lace as in claim 2 wherein said shoe lace has a retroreflective surface.

* * * * *